United States Patent [19]

Rehm et al.

[11] Patent Number: 5,042,597

[45] Date of Patent: Aug. 27, 1991

[54] HORIZONTAL DRILLING METHOD AND APPARATUS

[75] Inventors: William A. Rehm, Houston; Thomas D. Trunk, Sugarland; Timothy D. Baseflug, Houston; Steve L. Cromwell, Houston; Grady A. Hickman, The Woodlands; Ralph D. Nickel, Spring; Michael S. Lyon, Houston, all of Tex.

[73] Assignee: Becfield Horizontal Drilling Services Company, Houston, Tex.

[21] Appl. No.: 598,583

[22] Filed: Oct. 15, 1990

Related U.S. Application Data

[63] Continuation of Ser. No. 340,960, Apr. 20, 1989, abandoned.

[51] Int. Cl.[5] ..... E21B 7/08

[52] U.S. Cl. ..... 175/61; 175/62; 175/74; 175/75; 175/408

[58] Field of Search ..... 175/61, 62, 73, 74, 175/75, 399, 408

[56] References Cited

U.S. PATENT DOCUMENTS

| | | | |
|---|---|---|---|
| 3,449,030 | 6/1969 | Tiraspolsky et al. . | |
| 3,594,106 | 7/1971 | Garrison . | |
| 3,879,094 | 4/1975 | Tschirky et al. . | |
| 4,114,704 | 9/1978 | Maurer et al. . | |
| 4,475,605 | 10/1984 | Ioanesian et al. | 175/45 |
| 4,484,641 | 11/1984 | Dismukes | 175/61 |
| 4,577,701 | 3/1986 | Dellinger et al. | 175/61 |
| 4,638,873 | 1/1987 | Welborn | 175/73 |
| 4,646,831 | 3/1987 | Marsh et al. | 175/45 |
| 4,653,598 | 3/1987 | Schuh et al. | 175/61 |
| 4,665,997 | 5/1987 | Maurer et al. . | |
| 4,789,032 | 12/1988 | Rehm et al. | 175/45 |
| 4,813,497 | 3/1989 | Wenzel | 175/61 |
| 4,938,298 | 7/1990 | Rehm | 175/61 |

OTHER PUBLICATIONS

Rollins, H. M., "Bit Guiding Tools Provide Better Control of Directional Holes", World Oil, Jun. 1966.

Rehm et al., "Horizontal drilling in mature oil fields," SPE Paper No. 18709 (1989), pp. 1-15.

Maurer et al., "Selecting Pad Heights for the First Austin Chalk Drainhole Test," May 30, 1985, pp. 1-10.

Tiraspolsky, "Hydraulic Downhole Drilling Motors" (1985), pp. 193-194.

Taylor et al., "A Systematic Approach to Well Surveying Calculations," SPE Paper No. 3362 (1971), pp. 474-488.

"Horizontal re-completion techniques refined," *Drilling Contractor* (Dec. 1988/Jan. 1989).

Rehm, "Horizontal Drilling Applied in Slim Holes," *Petroleum Engineer*, Feb. 1987.

Ehlers et al., "Case History of Horizontal Wells Drilled with Navigation Technology in European Operations," SPE Paper No. 18654 (1989), pp. 315-324.

Whitten et al., "Unleashing the Power of Steerable Systems," SPE Paper No. 18655 (1989), pp. 325-332.

Karlsson et al., "New Developments in Short-, Medium-, and Long-Radius Laterial Drilling," SPE Paper No. 18706 (1989), pp. 725-736.

Jourdan et al., "How to Build and Hold a 90° Angle Hole," SPE Paper No. 18707 (1989), pp. 737-748.

Rehm, "Horizontal recompletions and costs with present technology," pp. 1-7, paper as yet unpublished, prepared for Int'l Horizontal Drilling and Completion Conference.

*Primary Examiner*—Bruce M. Kisliuk

*Attorney, Agent, or Firm*—Townsend and Townsend

[57] ABSTRACT

A method and apparatus for drilling highly deviated wells is disclosed. A drilling assembly is attached to a drill string. The drilling assembly includes a bent sub, a pony collar attached to the bent sub, a motor with a bent housing, and a bit. Improved survey collars and bits are also disclosed.

8 Claims, 2 Drawing Sheets

HORIZONTAL DRILLING METHOD AND APPARATUS

This is a continuation of application Ser. No. 340,960, filed Apr. 20, 1989, now abandoned.

BACKGROUND OF THE INVENTION

1. Field of the Invention

The present invention is related to the field of well drilling. In particular, the present invention provides an improved method and apparatus for drilling highly deviated and horizontal wells in a hydrocarbon bearing formation.

2. Description of Related Art

In the field of petroleum exploration and production, the use of directionally drilled wells is commonplace. Directionally drilled wells are commonly used in offshore locations, urban locations, and other locations where it becomes necessary to drill wells into formations that are laterally displaced from the drilling location.

With recent downturns in petroleum prices, it has become increasingly important from an economic point of view to more fully develop known petroleum reserves rather than explore for new reserves. Highly deviated, or horizontally drilled wells have, therefore, been increasingly utilized to develop those known petroleum reserves. Horizontal wells can be used, for example, to contact vertical fractures and other fracture systems which would otherwise be inaccessible from vertical or nearly vertical wells.

A variety of methods have been proposed for drilling highly deviated or horizontal wells. For example, the use of down-hole motors is known and has been used in both the petroleum business and in under-river drilling, coal drilling, and the like. The use of down-hole motors using a bent motor housing is disclosed in, for example, Rehm, "Horizontal Drilling Applied in Slim Holes," *Petroleum Engineer International*, Feb. 1987. See also U.S. Pat. No. 4,789,032, entitled "Orienting an Circulating Sub", and Rehm, "Horizontal Drilling In Mature Oil Fields," SPE Paper No. 18709 (1989), both of which are incorporated herein by reference for all purposes.

In the above-described horizontal drilling methods, a vertical section of well is drilled using methods well known to those of skill in the art. Alternatively, an existing vertical or nearly vertical well may be utilized. A section of casing is milled out and a cement plug is placed in the milled-out section. After drilling out a short distance (e.g., 20 feet), a sidecutting or "turning" drilling assembly is run into the hole. The side-cutting drilling assembly generally includes a down-hole motor which rotates an adjacent bit.

The down-hole motor is utilized to drill a curved portion of the well. The motor is driven by drilling fluids pumped from the surface and is housed in a "bent" housing. The bent housing provides the necessary force to drill the well in a curved fashion. Curvature is, alternatively, induced by a bent sub to which the motor is mounted and/or a pad mounted to the drill string adjacent the sub.

In order to drill the well in the desired direction, a mule key orienting sub is provided. A suitable mule key orienting sub is disclosed in U.S. Pat. No. 4,789,032. Drilling of the well is monitored with survey equipment of the type known to those of skill in the art. Upon reaching a desired drilling direction (e.g., horizontal) the bent drilling assembly is replaced with a straight drilling assembly, and drilling continues.

In using the prior known methods of drilling highly deviated wells, a number of problems have arisen. In particular, it has been found that drill bits (which generally have a long gauge shoulder) have been of limited value in that their drilling rate is slow, and excessive wear on the gauge and center has occurred.

Further, it has been observed that the downhole motor creates significant vibration (due at least in part to the high motor speeds of 600—700 RPM) which can lead to failure cf the steering mechanism and that in some cases the motor lifts off of the bottom side of the hole. This factor, along with others, can also result in curvature of the wellbore that is outside of the range that would be predicted for the drilling assembly.

Still further, in conventional turning assemblies, pick-up drag can be up to 50% of the free weight of the drilling assembly. This can cause particular problems in well recompletion operations wherein it is often desirable to use smaller drilling rigs.

Finally, when turning to horizontal, drag forces on the drill pipe occur which make it difficult to control the weight on the bit. Accordingly, it is desirable to have a down-hole assembly that turns the curve independent of weight. Conventional directional drilling assemblies use weight (on the bit) as a method of forcing the assembly to turn. They turn typically at 1/10 of the rate of this assembly and are unable to consistently turn at rates above six degrees per 100 feet.

Accordingly, it is seen that an improved method and apparatus for drilling deviated wells is desired.

SUMMARY OF THE INVENTION

An improved method and apparatus for drilling highly deviated wells is disclosed. The drilling assembly can be used to drill wells with as much as 15,000 feet of pipe and still turn and be guided within $\pm 1°$ per 100 feet. These results can be obtained without the need for active guidance devices and are independent of weight on the assembly. Further, the device can be run into the hole and around curves with very little slack-off drag and, conversely, can be pulled out of the hole with very little pick-up drag. This is especially important in recompletion efforts because small drilling rigs with limited hoisting capacities are often used in such well recompletion efforts.

Slack-off and pull-out drag are decreased by providing a "slick" assembly. In particular, the components of the assembly are preferably of the same diameter (i.e., they are all externally flush) so as to reduce the slack-off and pull-out drag. The invention described herein may, for example, require overpull of only 5,000 pounds and push of 3,000 pounds for an 80,000-pound string.

Greater flexibility is provided to the drilling assembly through the use of aluminum or aluminum alloy survey collars in combination with, for example, conventional steel pipe. These flexible collars (which are normally considered undesirable in oil field drilling operations due to their tendency to fail during rotation of the pipe) provide dampening of vibrations and easier turning, without failure due to the use of a down-hole motor.

A desired turning radius is better achieved through the use of a pony collar. The pony collar is a particularly heavy section of pipe which serves to keep the motor laying against the bottom of the hole. In a preferred embodiment the pony collar is located between a bent motor housing and a bent sub.

Accordingly, in one embodiment, the drilling assembly includes a drill string; a bent section attached to the drill string; a fluid-operated motor attached to the bent section; and a drill bit attached to the fluid-operated motor, the drill bit further comprising a gauge shoulder, the gauge shoulder having a width of about 3 inches to 4½ inches. Preferably the gauge shoulder has a width of about 3 inches.

In an alternative embodiment, the drilling assembly includes a drill string; a bent section attached to the drill string; a fluid-driven motor attached to the bent section; a bit attached to the fluid-driven motor; and at least one survey collar above the bit, the survey collar comprising a metal selected from the group aluminum or monel tubing.

In a further embodiment the apparatus includes a drill string; a bent section attached to the drill string; a pony collar attached to the bent section opposite the drill string; a motor attached to the pony collar opposite the bent section, the motor having a bent housing; and a bit attached to the motor. The pony collar is preferably a section of pipe having sufficient mass to maintain the motor against the side of the wellbore and reduce vibration on a steering tool.

DETAIL(D DESCRIPTION OF THE INVENTION

Figure 1A:
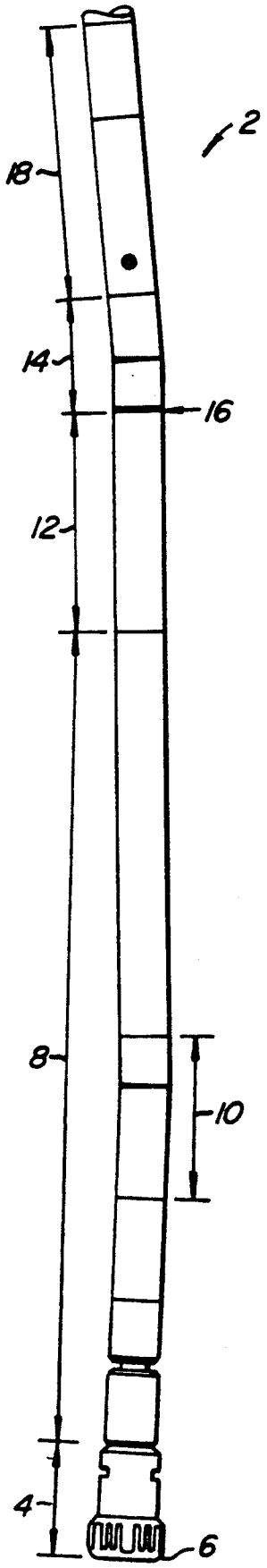
FIGS. 1*a* to 1*c* provide an overall view of the drilling assembly.
Figure 1B:
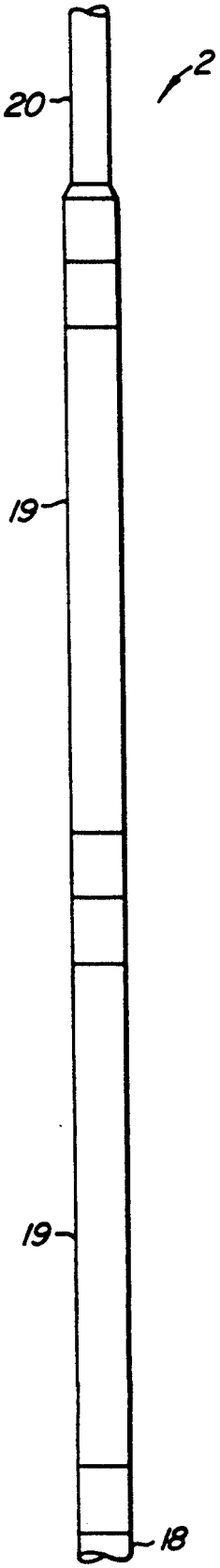
Figure 1C:
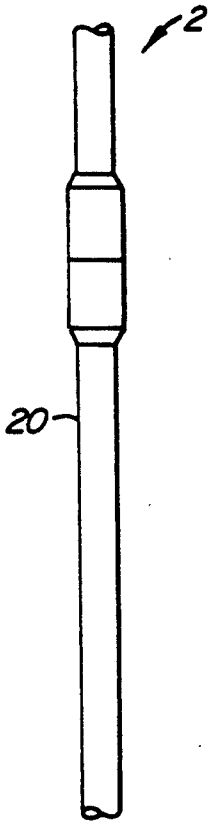

FIGS. 1*a* to 1*c* illustrate a bottom hole assembly (BHA) 2 suited for drilling highly deviated wellbores. By "highly deviated" it is intended herein to mean wellbores which have a deviation from the vertical of about 45° or more. The BHA described herein is especially suited for drilling wells in which a portion of the wellbore is substantially horizontal, i.e., in which a portion of the wellbore is drilled at approximately 90° from the vertical.

The BHA 2 includes a bit 4. Two general types of bits are used herein. The type of bit used in drilling the straight, horizontal portion of the wellbore is of relatively conventional design. The bit used in drilling a curved portion of the wellbore is a short shoulder drill bit and may be a diamond or PDC side tracking type bit with a large concave or convex nose 6. By "short shoulder" it is intended to mean herein that the shoulder (i.e., distance along the farthest outside diameter) of the bit is about 3 inches or less for 2⅞" drill pipe. In addition, the nose of the bit, i.e., the forward-most projection of the bit (which may be concave or convex), is larger than normal and, in a preferred embodiment is about 3 inches for a 4-inch drill pipe, and 4¼ inches for a 6-inch drill pipe. Optionally, a short skirt, 3-cone bit may be utilized in which the teeth are offset outward (i.e., they cut outward) and a tracking cone (i.e., a cone where the teeth track behind each other cogwise) is provided.

The bit disclosed herein has been found to be unique in that it will turn more readily in response to the directional forces applied by the drill string/drilling assembly. The force through the bent housing on the motor includes two directional forces, i.e., a force which is at a right angle to the motor and one which is along the axis of the motor. The force which is at right angles to the motor is approximately proportional to the tangent of the angle of the bent sub. The bit disclosed herein behaves more closely in accord with, for example, the predictions of U.S. application Ser. No. 315,882, entitled "Directional Well Control." Conventional bits resist turning because of their straight-hole design. They will often start to make a curve as a directional force is applied, but the curve will not be consistent due to interference of, for example, the skirt of the bit.

The bit used in the curve preferably has a design that varies depending upon whether the well is to be drilled with a radius of less than 200 feet, 200–500 feet, or above 500 feet. The bits in these three categories vary in that the short radius bits have less shoulder or skirt and less concavity or convexity.

Figure 2A:
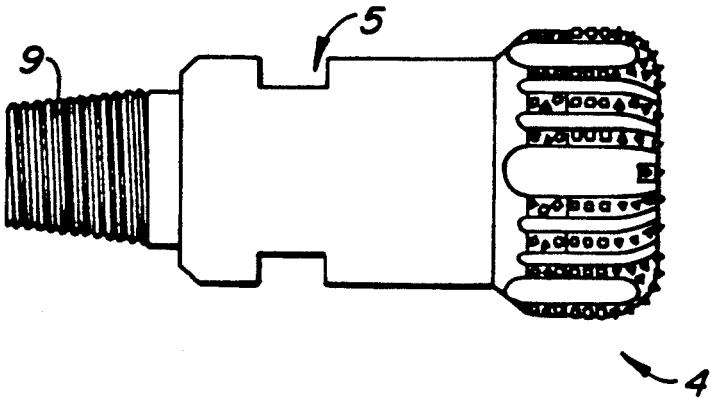
FIGS. 2*a* and 2*b* provide greater detail regarding the bit.
Figure 2B:
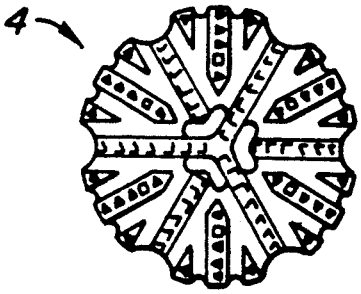

The bit is illustrated in side and front view in more detail in FIGS. 2*a* and 2*b*, respectively. As shown, the shoulder length, i.e., the distance along the largest outside diameter of the bit is preferably about 3 inches or less, for e.g., 2⅞ inch diameter drill string. A notch 5 is provided for improved circulation. Male connector 9 is used for connection to a motor. Table 1 illustrates preferred dimensions for the bit based on the radius of curvature of the wellbore.

TABLE 1

| Hole Radius | Gauge Skirt |
|---|---|
| <200' | 2 inches or less |
| 200–500' | 3 inches or less |

Referring again to FIG. 1, a motor 8 is attached to and drives the bit 6. The motor is preferably a fluid-driven motor of the type more fully described in U.S. Pat. No. 4,789,032. The motor is provided with a bent housing 10. The bent housing 10 presses against a wellbore (not shown) and serves to force the drill bit sideways as the well is drilled. Preferably, the motor is proportioned such that it has a diameter of no more than 75% of the hole diameter and no less than 50% of the hole diameter. If necessary, a sleeve is installed around the motor to bring the diameter up to 50% of the hole diameter. Further, the length of the motor should be no more than 5% of the turning radius of the hole to be drilled. In a preferred embodiment, the motor is not provided with an offset pad or thruster pad on the bend housing because the pad causes drag in the hole. Housings having different bend angles may be used in drilling the wellbore.

The angle at which the motor housing is bent plays a significant role in the radius of turn of the BHA and is selected based upon the desired turning radius of the well. For example, in one embodiment a bend angle of approximately between about 0° and 2° will produce an acceptable turning radius in most wells. It will be apparent to those of skill in the art that a wide range of bend angles will be useful herein. The motor may be bent at, for example, up to 4°. The turning radius of a given drilling assembly may be predicted using the method disclosed in copending application Ser. No. 315,882, entitled "Directional Well Control."

Above motor 10, a pony collar 2 is attached. The pony collar is a short section of drill collar which is approximately the same outside diameter as the motor housing, and, in a preferred embodiment, is about one third the length of the motor. The pony collar is a section of pipe which is heavier per unit of length than the remaining components of the drilling assembly. In a preferred embodiment the pony collar is heavier than about 20 lbs/ft, with a small internal diameter. The purpose of the pony collar is to hold the motor housing against or tangent to the low side of the hole. By ensuring that the motor remains against the wellbore wall, the turning radius produced by a drilling assembly will be consistent and in closer accord with predicted turning radius. The pony collar also serves to absorb motor vibrations and reduce the vibrational forces on the steering tool.

The pony collar is most preferably between 50 inches and 100 inches long. In a preferred embodiment the pony collar is constructed of monel or steel and has a diameter of about 3½ inches. Accordingly, in a preferred embodiment the pony collar weighs about 200 lbs for a 3½-inch motor, and 600 lbs for a 4¾ inch motor, although it is anticipated that beneficial results can be obtained with pony collars weighing from about 200 lbs to about 1000 lbs.

Above pony collar 12, a bent sub 14 is attached. Bent sub 14 is preferably a tubular section of pipe which is bent at approximately 0.5 to 1.5 degrees. In a preferred embodiment, bent sub 14 is bent at approximately 1°. The bent sub 14 serves to maintain the pony collar and section of the motor housing between the bend in the motor and the pony collar flush against the wellbore. The use of such a bent sub in combination with a bent motor housing substantially increases the predictability of the turning radius of the drilling assembly.

The bent sub 14 should be oriented on the drilling assembly such that the bend in the bent sub is in-line with the bend of the motor housing, i.e., the sub should be bent in the same plane as the motor housing. A series of shim rings 16 enable the bent sub to be attached tightly to the pony collar and be in-line with the bend of the motor housing. In a preferred embodiment a set of the shim rings varying from ⅛ to ½ of the thread pitch of the threads on the pony collar/bent sub are used.

Above bent sub 14, an orienting sub 18 is attached. Orienting sub 18 may, for example, be of the type described in U.S. Pat. No. 4,789,032, which is incorporated herein by reference. Orienting sub 18 contains a key/latch assembly (not shown) which serves to properly align survey equipment of the type known to those of skill in the art with the bend in bent sub 14 and bent motor housing 10.

Above the orienting sub, one or more survey collars 19 are provided. Survey collars 19 are preferably made of aluminum and are of approximately the same diameter as the drill string. The collars preferably have externally flush tool joints.

The aluminum tubing survey collars (or collars comprising a substantial amount of aluminum) have seldom been used in the oil field environment because they are inadequate to transmit weight to the bit and tend to fail due to stressing during rotation of the drill pipe. The aluminum survey collars are preferred in conjunction with the deviated well drilling assembly herein because they dampen vibrations of the motor and provide easy turning because they are only about one fifth as stiff as steel. In general, any non-magnetic material which is sufficiently flexible to act as a weak joint (commonly referred to as a Gilligan joint) can be utilized as a survey collar. These joints provide sufficient bending and do not fail because the bit is driven from a down-hole motor.

Above the survey collars, drill pipe 20 is provided. Drill pipe 20 is preferably externally flush. By providing a "slick" drilling string/assembly pick-up drag can be reduced to about 10% of the free weight of the assembly. Further, as pipe is pulled out of the hole, key seating is avoided because there are no external protrusions on the pipe to erode or cut out the hole. Importantly, since many horizontal wells will be drilled from existing wells, the assembly can also be pulled out of and run into holes cut into the side of well casing.

In drilling the well, traditional drilling mud is preferably substituted with completion fluids. It has been found that solids in traditional muds result in stuck pipe and cause skin damage to the formation. Further, it is preferred that lost circulation materials such as ground nut hulls be avoided because of the small clearances of the drilling assembly. If lost circulation materials become necessary, it is preferred to add ¼% or less of mica.

It is to be understood that the above-described embodiments are intended to be illustrative and not restrictive. For example, while the invention has been described with particular reference to drilling horizontal wells, the invention herein could be utilized with any highly deviated well. The scope of the invention should, therefore, be determined not with reference to the above description but, instead, should be determined with reference to the appended claims, along with their full scope of equivalents.

What is claimed is:

1. Apparatus for drilling a highly deviated well into a petroleum formation said apparatus comprising a drill pipe extending from a surface location to a down-hole drilling assembly through a curved wellbore, said down-hole drilling assembly comprising:

a) a down-hole motor attached to a bit at a first end, said down-hole motor having a bent housing;

b) a bent sub in said down-hole drilling assembly located above said motor; and c) a pony collar located between said motor and said bent sub, said pony collar having sufficient mass to substantially hold said motor against a wellbore wall during drilling operations.

2. Apparatus as recited in claim 1, wherein said pony collar has a mass between about 200 lbs and 1000 lbs.

3. Apparatus as recited in claim 1 further comprising a steering apparatus above said pony collar.

4. Apparatus as recited in claim 1, wherein said pony collar is constructed according to the following table:

| drilling assembly outside Diameter | Pony Collar Mass |
|---|---|
| 2⅞" | Greater than 200 lbs. |
| 2½" | Greater than 500 lbs. |

5. Apparatus for drilling a deviated wellbore comprising:

a) a bit assembly comprising a bit attached to a down-hole motor, said motor drivable with drill fluids;

b) drill pipe attached to said motor, said drill pipe further connected to said motor with at least one survey collar, said survey collar comprising a metal selected from the group aluminum and aluminum mixtures; and c) wherein said survey collar acts as a Gilligan joint in said drill pipe.

6. Apparatus as recited in claim 5, wherein said survey collars have externally flush tool joints.

7. Apparatus for drilling a wellbore with a turn radius of less than 500 feet into a petroleum formation, said wellbore at least partially horizontal, comprising:

a) a drill bit, said drill bit having a gauge shoulder of less than about 3 inches;

b) a down-hole, fluid- driven motor for rotating said drill bit, said motor having a bent housing, said bend less than about 4°;

c) a pony collar attached to said motor, said pony collar having mass of at least about 200 pounds;

d) a bent sub above said pony collar, said bent sub bent in the same plane as said motor housing; and e) a drill string attached to said bent sub, said drill string further comprising a plurality of externally-flush survey collars, said survey collars comprising aluminum.

8. A method of drilling a wellbore having in a petroleum formation, at least a portion of said wellbore deviated at a turn radius of less than about 500 feet, comprising the steps of:

a) providing a vertical section of wellbore;

b) inserting into said wellbore with drill pipe a deviated well drilling assembly, said drilling assembly comprising a bit, a bent section, a down-hole motor, and a pony collar, said down-hole motor driveable by fluids from a surface location, said pony collar having greater mass per length than the remainder of said drilling assembly, said drilling assembly having a diameter of about 5 inches or less; and c) driving said motor with a fluid.

* * * * *